US005139617A

United States Patent [19]

Tikka et al.

[11] Patent Number: 5,139,617

[45] Date of Patent: Aug. 18, 1992

[54] PROCESS FOR THE PRODUCTION OF A HEMICELLULOSE HYDROLYSATE AND SPECIAL HIGH ALPHA CELLULOSE PULP

[75] Inventors: Panu O. Tikka, Espoo; Nils E. Virkola, Helsinki, both of Finland

[73] Assignee: Suomen Sokeri Oy, Helsinki, Finland

[21] Appl. No.: 535,287

[22] Filed: Jun. 8, 1990

Related U.S. Application Data

[63] Continuation of Ser. No. 420,647, Oct. 11, 1989, abandoned, which is a continuation of Ser. No. 180,210, Apr. 11, 1988, abandoned.

[30] Foreign Application Priority Data

Apr. 21, 1987 [FI] Finland ..... 871730

[51] Int. Cl.[5] ..... D21C 3/04; D21C 3/06; D21C 3/20

[52] U.S. Cl. ..... 162/72; 162/83; 162/84

[58] Field of Search ..... 162/83, 84, 72

[56] References Cited

U.S. PATENT DOCUMENTS

| | | | |
|---|---|---|---|
| 1,880,046 | 9/1932 | Richter | 162/83 |
| 3,532,597 | 10/1970 | Ljunggvist | 162/84 |
| 3,832,278 | 8/1974 | Villavicencio | 162/84 |
| 4,213,821 | 7/1980 | Vanderhoek et al. | 162/72 |

FOREIGN PATENT DOCUMENTS

| | | |
|---|---|---|
| 1216105 | 1/1987 | Canada . |
| 2628971 | 1/1978 | Fed. Rep. of Germany . |
| 67104 | 6/1989 | Finland . |

OTHER PUBLICATIONS

Abstract No. 8770 of Bulletin of the Institute of Paper Chemistry.

Wong, "Sulfide Pulping: A Review of Its History and Current Technology", *Pulp & Paper*, Nov. 1980, pp. 74–81 (162–83).

Zakhariev, Ch.: et al. "Possibility of Obtaining Sugar Solutions from Beechwood to be Used for Manufacture of Semichemical Pulp", ABIPC Vol. 56, No. 8 (Feb. 1986) Abstract 8910.

"Cooking of Sulfate Pulp" by B. Z. Smolyanitskii; Lesnaya Promyshlennost Publishers, Moscow, 1983, p. 7.

*Primary Examiner*—Steve Alvo

*Attorney, Agent, or Firm*—Brumbaugh, Graves, Donohue & Raymond

[57] ABSTRACT

A process for the production of a hemicellulose hydrolysate and special pulp through two steps, the first step comprising the prehydrolysis of the material and the second step the dissolving of the lignin contained in the prehydrolyzed material. According to the process the lignin dissolving is carried out by neutral sulphite cooking with anthraquinone or a derivative thereof as a catalyst, the pH of the cooking liquor being initially at least 10.

10 Claims, No Drawings

PROCESS FOR THE PRODUCTION OF A HEMICELLULOSE HYDROLYSATE AND SPECIAL HIGH ALPHA CELLULOSE PULP

This application is a continuation of application Ser. No. 420,647, filed on Oct. 11, 1989, which, in turn, is a continuation application of Ser. No. 180,210 filed Apr. 11, 1988, both now abandoned.

The invention relates to a process for the production of a hemicellulose hydrolysate and special pulp from a material containing lignocellulose through two steps, the first step comprising the hydrolysis of hemicelluloses into simple sugars and the second step the dissolving of lignin for liberating cellulose fibres.

BACKGROUND OF THE INVENTION

Traditionally, there are two processes for the production of special pulps having a high content of alpha cellulose, such as dissolving pulp: the far-advanced acidic bisulphite cooking and the prehydrolysis-sulphate cooking. The former was developed at the beginning of the 20th century and the latter in the 1930's, see e.g. Rydholm, S. E., Pulping Processes, p. 649 to 672, Interscience Publishers, New York, 1968. The basic idea in both processes is to remove as much hemicellulose as possible from cellulose fibres in connection with the delignification so as to obtain a high content of alpha cellulose. This is essential because the various uses of dissolving pulp, for instance, do not tolerate short-chained hemicellulose molecules with indefinite structure. In the sulphite process, the removal of hemicellulose takes place during the cooking simultaneously with the dissolving of lignin. The cooking conditions are highly acidic and the temperature varies from 140° to 150° C., whereby the hydrolysis is strong. The result, however, is always a compromise with delignification, and no high content of alpha cellulose is obtained. Another drawback is the decrease in the degree of polymerization of cellulose and the yield losses, which also limit the hydrolysis possibilities. Various improvements have been suggested in traditional sulphite cooking, the use of additional chemicals, for instance. Such additional chemicals, used in addition to the basic chemicals of sulphite cooking, include sulphide, white liquor, and anthraquinone, see e.g. Finnish Patent Specification 67 104 and U.S. Pat. No. 4,213,821. These sulphite cooking variations do not, however, imply hydrolytic conditions.

A separate prehydrolysis step is interesting in the view of the fact that it enables the adjustment of the hydrolysis of hemicelluloses as desired by varying the hydrolysis conditions. In the prehydrolysis-sulphate process the delignification is not carried out until in a separate second cooking step. The prehydrolysis is carried out either as a water prehydrolysis or in the presence of a catalyst. Organic acids liberated from wood in the water prehydrolysis perform a major part of the process, whereas small amounts of mineral acid or sulphur dioxide, in some cases even sulphite waste liquor, are added to the digester in "assisted" prehydrolysis. It has previously been necessary to effect the lignin dissolving step after the prehydrolysis as sulphate cooking which has several drawbacks. The prehydrolysis-sulphate process has e.g. the following drawbacks:

The yield is low because of the strong alkaline reaction conditions which cause splitting of cellulose. Thus the wood consumption per one ton of cellulose is high.

The content of residual lignin is rather high because the step for the removal of residual lignin in the sulphate cooking process is extremely non-selective. Thus there is a great need of bleaching for complete removal of lignin, and the consumption of chemicals is high; further, at least five bleaching steps are required.

Industrial realization of sulphate cooking is complicated, and the cost of investment very high.

Previously the use of sulphite cooking has not been possible, because it is not possible to dissolve from wood material lignin deactivated in the prehydrolysis by means of traditional sulphite cooking processes. It has been regarded as impossible to use a sulphite cooking step (cf. Rydholm above) even though it would have advantages over sulphate cooking.

SUMMARY OF THE INVENTION

It has now been found out unexpectedly that excellent results can be obtained by effecting the lignin dissolving after the prehydrolysis by an alkaline neutral sulphite cooking with anthraquinone or a derivative thereof as a catalyst. Such a cooking is known per se from the prior art (see e.g. U.S. Pat. No. 4,213,821); on the contrary, a combination of prehydrolysis and such a cooking has not been set forth previously.

BRIEF DESCRIPTION OF THE FIGURE

FIG. 1 shows graphically the lignin concentrations measured during the cooking step.

DETAILED DESCRIPTION OF THE INVENTION

The invention relates to a process for the production of hemicellulose hydrolysate and special pulp from a material containing lignocellulose through two steps, the first step comprising the prehydrolysis of the material and the second step dissolving of the lignin contained in the prehydrolyzed material. The process is characterized in that the dissolving of lignin is carried out by means of neutral sulphite cooking with anthraquinone or a derivative thereof as a catalyst, the pH of the cooking liquor being initially at least 10.

Suitable prehydrolyzing agents include e.g. water, mineral acid, sulphur dioxide, sulphite cooking acid, and sulphite waste liquor. Preferred prehydrolyzing agents include sulphur oxide, sulphuric acid, and water.

A suitable prehydrolyzing temperature is 100° to 180° C., preferably 155° to 170° C., and a suitable hydrolyzing time is 10 to 200 minutes, preferably 90 to 170 minutes.

The material containing lignocellulose preferably consists of softwood or hardwood.

The cooking step is suitably carried out with a cooking liquor comprising 100 to 400 g of sodium sulphite/kg of dry wood; 10 to 100 g of sodium carbonate-/one kg of dry wood; sodium hydroxide for rising the pH of the cooking liquor to a value between 10 and 13; and 0.01 to 0.2%, calculated on dry wood, of anthraquinone or a derivative thereof.

The cooking temperature preferably ranges from 160° to 180° C., and the cooking time is suitably 100 to 200 minutes after the temperature has risen 0.1 to 2° C./min from a temperature varying between room temperature and 100° C.

It is typical of the prehydrolysis-neutral sulphite-anthraquinone process (PH-NS-AQ process) that delignification to a low content of residual lignin is easy to carry out while the yield of cellulose fibre, however, remains on an exceptionally high level. Thus it is possible to use strong prehydrolysis conditions (e.g. strong acids, such as $H_2SO_4$), whereby the hydrolysis of hemicelluloses into simple sugars is efficient; on the other hand, the alpha cellulose content representing the content of residual hemicellulose in cellulose fibre is high and the content of residual pentosan is low. Due to these properties the process is particularly suitable for the production of high-quality dissolving pulp, for instance, whereby mono-saccharides are obtained simultaneously.

As to the new process, it was found out that the use of the so called neutral sulphite anthraquinone cooking process effects a partial ionization of the lignin inactivated in the prehydrolysis, the initial pH being at least 10, e.g. 11 to 12, and that anthraquinone as an additive in the cooking catalyzes the breaking of nucleophilic beta aryl ether bonds, which at the end results in the liberation of fibres, i.e. a successful cooking. It was further found out that sulphite ions in neutral sulphite cooking react simultaneously and participate in the decomposing of the structure of lignin and above all sulphonate the lignin material and fragments which thus become more hydrophilic and dissolve more easily in the cooking liquor, thus contributing to the formation of a successful cooking and to the continuation thereof to a very low content of residual lignin. In short, the prehydrolysis-neutral sulphite anthraquinone process according to the invention not only gives a result as successful as that of the sulphate process but also provides all the advantages typical of sulphite cooking.

The increased yield of the process according to the invention is due to the fact that there does not occur splitting of cellulose to any greater degree during the neutral sulphite cooking step. In sulphate cooking, on the contrary, the high alkalinity causes alkaline hydrolysis, and the peeling-off reaction in particular results irrevocably in a yield loss. The process according to the invention enables the recovery of nearly all of the high molecular weight cellulose material originally contained in the wood material.

In the process-chemical sense, another advantage is that pulp which has undergone neutral sulphite anthraquinone cooking is easy to bleach, i.e. the residual lignin remaining in the fibre after the cooking is easy to remove. This is due to the fact that the delignification resembles sulphite cooking; the condensation of the structure of lignin is insignificant; and the sulphonation makes lignin more hydrophilic. Contrary to this, the residual lignin in sulphate cooking is strongly condensated and the content thereof is on a higher level. The removal of this kind of residual lignin in bleaching requires five to six bleaching steps and plenty of expensive chlorine dioxide. The bleaching of pulp obtained by means of the process according to the invention can be carried out by three steps only and the demand of chemicals, too, is lower.

The process according to the invention has the following advantages:

The yield of the special pulp to be produced in connection with the production of sugars is increased, which improves the production economy.

The process after the prehydrolysis is simplified, which decreases the cost of investment.

The easier delignification in the cooking step decreases the need of bleaching, thus improving the production economy and reducing the emission of chlorinated compounds from the bleaching.

The oxygen or peroxide step after the cooking is extremely efficient as compared with that of the prehydrolysis-sulphate process, whereby the recovery and economy are improved.

Small-scale production is economically more interesting because it is possible to operate in connection with an existing sodium-based sulphite pulp mill without any appreciable additional investments.

The following examples are illustrative of the invention.

The following abbreviations are used in the examples:

| Steps of the bleaching processes | |
|---|---|
| O = | Oxygen step |
| D = | Chlorine dioxide step |
| E = | Alkali extraction |
| P = | Peroxide step |
| H = | Hypochlorite step |
| C = | Chlorination |
| Standards | |
| SCAN = | Scandinavian standard |
| TAPPI = | U.S. standard |

EXAMPLE 1

Production of a Birch Hydrolysate and Special Pulp by Means of the PH-NS-AQ Process From Birch Chips Chips and a prehydrolyzing liquor were metered into a chip basket positioned in a 20-liter forced circulation digester. The cover of the digester was closed and the prehydrolysis was carried out according to the temperature program by heating the digester circulation indirectly by means of steam. After the hydrolysis time had passed, the hydrolysate was removed from the digester and recovered. The prehydrolyzed chip material contained in the digester was washed in the digester for 5 minutes with warm water, the cover was opened, and the chips were passed into a centrifuge in which excess water was removed. The centrifugalized material was weighed and a dry substance sample was taken for determining the hydrolysis loss.

The prehydrolyzed chip material was returned to the digester, cooking liquor and anthraquinone were added, the cover was closed, and the cooking was carried out according to the temperature program. At the end of the cooking the cooking liquor was removed rapidly and the digester was filled with cold water, whereafter water was allowed to flow for 10 hours for washing the cooked chip material. After the wash the pulp was disintegrated by means of a wet disintegrator for one minute and assorted with a flat screen plate of 0.35 mm. Shives were recovered and weighed dry for determining the shive content. The accepted fraction was passed into the centrifuge for dewatering, homogenized, and weighed. Laboratory analyses were carried out on this pulp and the pulp was further used in bleaching tests.

| Prehydrolyzing step | |
|---|---|
| Wood amount, g of abs. dry chips | 2000 |
| Prehydrolyzing agent | $SO_2$ |
| Amount of prehydrolyzing agent, % on dry wood | 0.25 |
| Liquor ratio | 6:1 |
| Temperature rising time, min | 40 |
| Prehydrolysis temperature, °C. | 155 |
| Prehydrolysis time, min | 170 |
| Prehydrolysis loss, % on wood | 26.6 |

-continued

| | |
|---|---|
| Cooking step | |
| $Na_2SO_3$, % on wood as NaOH | 22 |
| $Na_2CO_3$, % on wood as NaOH | 5 |
| Anthraquinone, % on wood | 0.1 |
| Liquor ratio | 4.5:1 |
| pH of the cooking liquor | 11.3 |
| Rising of the temperature °C./min | 1 |
| Cooking temperature, °C. | 175 |
| Cooking time, min | 170 |
| Yield, % on wood | 39.3 |
| Kappa number | 17.2 |
| Shive content, % on wood | 0.1 |
| Properties of O-D-E-D bleached pulp | |
| Final yield, % of wood | 36.7 |
| ISO brightness | 87.1 |
| Alpha cellulose % | 94.2 |
| Viscosity, SCAN $dm^3/kg$ | 764 |

EXAMPLE 2

Production of a Birch Hydrolysate and Special Pulp by the PH-NS-AQ Process From Birch Chips The test was carried out as disclosed in Example 1.

| | |
|---|---|
| Prehydrolyzing step | |
| Wood amount, g of abs. dry chips | 2500 |
| Prehydrolyzing agent | $SO_2$ |
| Amount of prehydrolyzing agent, % on dry wood ($SO_2$) | 0.25 |
| Liquor ratio. | 3.5:1 |
| Temperature rising time, min | 40 |
| Prehydrolysis temperature, °C. | 155 |
| Prehydrolysis time, min | 170 |
| Cooking step | |
| $Na_2SO_3$, % on wood as NaOH | 20 |
| $Na_2CO_3$, % on wood as NaOH | 6 |
| Anthraquinone, % on wood | 0.1 |
| Liquor ratio | 4.5:1 |
| pH of the cooking liquor | 11.3 |
| Rising of the temperature °C./min | 1 |
| Cooking temperature, °C. | 175 |
| Cooking time, min | 170 |
| Yield, % on wood | 46.7 |
| Kappa number | 48.1 |
| Shive content, % on wood | 1.35 |
| Properties of O-P-H bleached pulp | |
| Final yield, % on wood | 39.7 |
| ISO brightness | 87.1 |
| Alpha cellulose % | 91.7 |
| Viscosity, SCAN $dm^3/kg$ | 530 |

EXAMPLE 3

Production of a Birch Hydrolysate and Special Pulp by the PH-NS-AQ Process From Birch Chips The test was carried out as disclosed in Example 1.

| | |
|---|---|
| Prehydrolyzing step | |
| Wood amount, g of abs. dry chips | 2500 |
| Prehydrolyzing agent | $H_2SO_4$ |
| Amount of prehydrolyzing agent, % on dry wood | 1.0 |
| Liquor ratio | 3.5:1 |
| Temperature rising time, min | 40 |
| Prehydrolysis temperature, °C. | 155 |
| Prehydrolysis time, min | 90 |
| Prehydrolysis loss, % on wood | 25.4 |
| Cooking step | |
| $Na_2SO_3$, % on wood as NaOH | 22 |
| $Na_2CO_3$, % on wood as NaOH | 5 |
| Anthraquinone, % on wood | 0.1 |
| Liquor ratio | 4.5:1 |
| pH of the cooking liquor | 11.3 |

-continued

| | |
|---|---|
| Rising of the temperature °C./min | 1 |
| Cooking Temperature, °C. | 175 |
| Cooking time, min | 170 |
| Yield, % on wood | 37.0 |
| Kappa number | 24.9 |
| Shive content, % on wood | 0.6 |
| Properties of C-E-D bleached pulp | |
| Final yield, % on wood | 34.2 |
| ISO brightness | 90.0 |
| Alpha cellulose % | 94.6 |
| Viscosity, SCAN $dm^3kg$ | 730 |
| Properties of O-P-D bleaching pulp | |
| Final yield, % on wood | 34.7 |
| ISO brightness | 84.4 |
| Alpha cellulose % | 94.5 |
| Viscosity, SCAN $dm^3/kg$ | 720 |

EXAMPLE 4

Production of a Pine Hydrolysate and Special Pulp by the PH-NS-AQ Process From Pine Chips The test was carried out as disclosed in Example 1.

| | |
|---|---|
| Prehydrolyzing step | |
| Wood amount, g of abs. dry wood | 2000 |
| Prehydrolyzing agent | $H_2O$ |
| Liquor ratio | 6:1 |
| Temperature rising time, min | 45 |
| Prehydrolysis temperature, °C. | 170 |
| Prehydrolysis time, min | 15 |
| Prehydrolysis loss, % on wood | 13.2 |
| Cooking step | |
| $Na_2SO_3$, % on wood as NaOH | 22 |
| $Na_2CO_3$, % on wood as NaOH | 5 |
| Anthraquinone, % on wood | 0.2 |
| Liquor ratio | 4.5:1 |
| pH of the cooking liquor | 11.3 |
| Rising of the temperature °C./min | 1 |
| Cooking temperature °C. | 175 |
| Cooking time, min | 170 |
| Yield, % on wood | 40.3 |
| Kappa number | 16.5 |
| Shive content, % on wood | 0.4 |
| Properties of O-D-E-D bleached pulp | |
| Final yield, % on wood | 37.2 |
| ISO brightness | 84.2 |
| Viscosity, SCAN $dm^3/kg$ | 890 |

REFERENCE EXAMPLE

It was studied how lignin dissolves in cooking processes generally in use as compared with the cooking step of the process according to the invention when the chips are prehydrolyzed according to the prior art. Sulphate cooking and various modifications of sulphite cooking are processes in general use.

In the tests the prehydrolysis/cooking was carried out as follows:

| |
|---|
| Test 1 |
| Sulphur dioxide water prehydrolysis, normal |
| Normal acidic Ca bisulphite cooking step |
| Kappa number 150 |
| Test 2 |
| Sulphur dioxide water prehydrolysis, normal |
| Normal acidic Ca bisulphite cooking step |
| Kappa number 126 |
| Test 3 |
| Water prehydrolysis, weak |
| Normal acidic Ca bisulphite cooking step |
| Kappa number 118 |
| Test 4 |

-continued

| |
|---|
| Sulphur dioxide water prehydrolysis, weak |
| Neutralizing lime milk treatment |
| Acidic Ca bisulphite cooking step with an extremely high bound $SO_2$ |
| Kappa number 106 |
| Test 5 |
| Sulphur dioxide prehydrolysis |
| Cooking step 1: ammonium neutral sulphite cooking |
| Cooking step 2: sulphur dioxide water acidic sulphite cooking |
| Kappa number 141 |
| Test 6 |
| Sulphur dioxide water prehydrolysis, normal |
| Neutral sulphite-anthraquinone cooking step |
| Kappa number 48 |
| Tent 7 |
| Sulphur dioxide water-prehydrolysis, normal |
| Sulphate cooking step, normal |
| Kappa number 14 |

Lignin concentrations measured from the digester during the cooking step by means of a cooking liquor analyzer as a function of the cooking time reduced to the same scale appear from the attached FIG. 1. The curves thus illustrate the dissolving of lignin as measured as an increase in the lignin content of the cooking liquor. The results show that the cooking step after the prehydrolysis in Tests 1 to 4 does not dissolve lignin efficiently even though attempts have been made to improve these sulphite processes as much as possible. The dissolving obtained in Test 5 was better because the prehydrolysis is exceptional and not technically reasonable. The content of residual lignin in Test 5 (the kappa number exceeding 100) is, however, technically impossible, the reasonable level being the kappa number of about 50 (=about 10% of lignin in cooked pulp). In Tests 6 and 7, lignin starts to dissolve rapidly in the relative cooking time of 100, the subsequent step being the main delignification of a successful cooking which is completed by a slow residual delignification towards the end of the cooking. In this way, the kappa level of 40 in Test 6 and the kappa level of 15 in Test 7 were achieved. Accordingly, it is obvious that an efficient removal of lignin from prehydrolyzed chip material takes place in the cooking step of the process according to the invention such as disclosed in Test 6; thus, it can replace the sulphate cooking used in Test 7.

The tests carried out show that normal technical prehydrolysis conditions inactivate lignin to such an extent that no cooking modification within an acidic or neutral cooking pH range is able to dissolve lignin even though the chip material would be neutralized between the prehydrolysis and the cooking. The sulphite cooking step used in the process according to the invention is operative only when the cooking conditions and the cooking catalyst are chosen appropriately.

We claim:

1. A process for the production of a hemicellulose hydrolysate and a special pulp from a material containing lignocellulose comprising the steps of (a) prehydrolyzing the material; and (b) cooking the prehydrolyzed material in an aqueous cooking liquor having an initial pH of 10 to 13, said cooking liquor consisting essentially of 100 to 400 grams of sodium sulfite per kilogram of dry material and 10 to 100 grams of sodium carbonate per kilogram of dry material, and 0.01 to 0.2%, by weight of dry material, of anthraquinone or a derivative of anthraquinone, thereby dissolving the lignin present in the material, to produce a special pulp having a high alpha cellulose content.

2. A process according to claim 2, wherein the material containing lignocellulose is hardwood.

3. A process according to claim 2, wherein the material containing lignocellulose is softwood.

4. A process according to claim 2, wherein the cooking is carried out at a cooking temperature of 160° to 180° C. for a period of 100 to 200 minutes.

5. A process according to claim 4, wherein the temperature of the cooking liquor is raised to the cooking temperature at a rate of from 0.1 to 2.0 degrees centigrade per minute from an initial temperature of between room temperature and 100° C.

6. A process according to claim 2, wherein the prehydrolysis is carried out by means chosen from the group consisting of water, sulphur dioxide and sulfuric acid.

7. A process according to claim 6, wherein the prehydrolysis is carried out at a temperature of 155° to 170° C. for a period of 90 to 170 minutes.

8. A process according to claim 6, wherein the cooking is carried out at a cooking temperature of 160° to 180° C. for a period of 100 to 200 minutes.

9. A process according to claim 8, wherein the initial pH of the cooking liquor is adjusted with sodium hydroxide.

10. A process according to claim 6, wherein the temperature of the cooking liquor is raised to the cooking temperature at a rate of from 0.1 to 2.0 degrees centigrade per minute from an initial temperature of between room temperature and 100° C.

* * * * *

UNITED STATES PATENT AND TRADEMARK OFFICE

CERTIFICATE OF CORRECTION

PATENT NO. : 5,139,617

DATED : August 18, 1992

INVENTOR(S) : Tikka et al.

It is certified that error appears in the above-identified patent and that said Letters Patent is hereby corrected as shown below:

Column 6, line 12, "bleaching pulp" should read --bleached pulp--;

Column 8, line 21, "claim 2" should read --claim 1--;

Column 8, line 23, "claim 2" should read --claim 1--;

Column 8, line 25, "claim 2" should read --claim 1--;

Column 8, line 34, "claim 2" should read --claim 1--.

Signed and Sealed this

Twenty-fifth Day of January, 1994

*Attest:*

Bruce Lehman

BRUCE LEHMAN

*Attesting Officer*

*Commissioner of Patents and Trademarks*